United States Patent [19]

Imaizumi et al.

[11] Patent Number: 4,590,464

[45] Date of Patent: May 20, 1986

[54] DISPLAY APPARATUS USING DOT MATRIXES

[75] Inventors: Mamoru Imaizumi; Kiyoshi Shibata, both of Nagoya, Japan

[73] Assignee: Brother Kogyo Kabushiki Kaisha, Nagoya, Japan

[21] Appl. No.: 486,069

[22] Filed: Apr. 18, 1983

[30] Foreign Application Priority Data

Apr. 22, 1982 [JP] Japan ..... 57-59981[U]

[51] Int. Cl.[4] ..... G09G 1/16

[52] U.S. Cl. ..... 340/711; 340/709; 340/721

[58] Field of Search ..... 340/709, 711, 723, 750, 340/735, 790, 721

[56] References Cited

U.S. PATENT DOCUMENTS

| | | | |
|---|---|---|---|
| 3,868,673 | 2/1975 | Mau | 340/723 |
| 4,163,229 | 7/1979 | Bodin | 340/735 |
| 4,203,102 | 5/1980 | Hydes | 340/723 |
| 4,359,730 | 11/1982 | Kunikane | 340/711 |
| 4,400,697 | 8/1983 | Currie | 340/711 |
| 4,443,794 | 4/1984 | Sakurai | 340/735 |
| 4,447,810 | 5/1984 | Lefebure | 340/790 |
| 4,458,243 | 7/1984 | Sado | 340/790 |
| 4,491,832 | 1/1985 | Tanaka | 340/735 |
| 4,495,491 | 1/1985 | Postl | 340/709 |

*Primary Examiner*—Marshall M. Curtis

*Attorney, Agent, or Firm*—Moonray Kojima

[57] ABSTRACT

A display apparatus comprising a display device for displaying a character and one or more special symbols to modify the character, by means of a dot matrix, and a control means for controlling the display device. The special symbols may be an underline sign, a bold face sign, etc. The control means effect alternate display at the same position on the display device, of a desired character and one or more special symbols to modify the desired character.

1 Claim, 9 Drawing Figures

DISPLAY APPARATUS USING DOT MATRIXES

BACKGROUND OF THE INVENTION

1. Field of Invention

This invention relates to an apparatus for displaying, by means of a dot matrix, characters and special symbols, such as an underline sign or a bold face discrimination sign, used to modify the displayed character.

2. Description of the Prior Art

In existing electronic typewriters and the like equipped with a display apparatus which displays characters and other data inputted from keys, a large number of display elements are required to constitute a dot matrix per character when displaying an underline below a desired character or directly displaying a bold face (i.e. thick) character. Particularly, in the case where the number of display elements is limited, disadvantageously, it becomes difficult to identify the character and special symbol or sometimes even impossible to achieve the display thereof.

SUMMARY OF THE INVENTION

Accordingly, an object of the present invention is to provide an improved apparatus capable of displaying both a character and one or more special symbols to modify the character, in an identifiable state.

Another object of the invention resides in providing an improved apparatus in which even a small display device having a limited number of dots per character ensures a discriminatable display of each character and one or more special symbols associated therewith.

A further object is to provide a display apparatus so constituted that a character and one or more special symbols for modifying the same, are displayed alternately, at the same positions on a display device so as to be completely distinguishable from each other.

A still further object is to provide a display apparatus equipped with a keyboard wherein each character inputted from the keyboard and one or more special symbols associated therewith, are displayed alternately on a dot matrix display device so that they are rendered distinguishable from each other.

A preferred embodiment according to the present invention, comprises a display device for displaying characters and symbols, by use of dot matrixes, and control means for effecting alternate display of each of desired characters and one or more special symbols, to modify the desired characters, with the alternate display being at the same position on the display device.

DETAILED DESCRIPTION OF THE PREFERRED EMBODIMENTS.

In order to make the present invention better understood, a conventional apparatus will be explained with reference to FIGS. 1(A), 1(B) and 1(C), prior to discussion of the preferred embodiment of the invention.

Figure 1A:
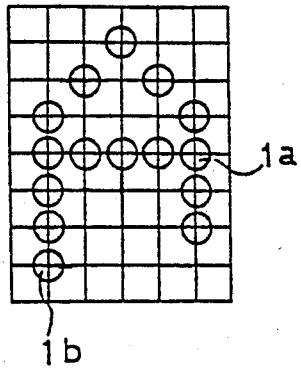
FIGS. 1(A), 1(B) and 1(C), each illustrates an exemplary display of one character and a special symbol on a conventional display device.
Figure 1B:
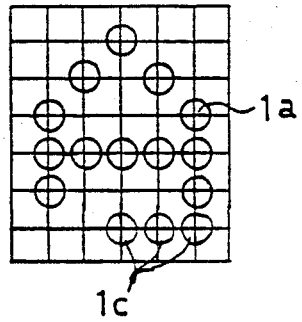
Figure 1C:
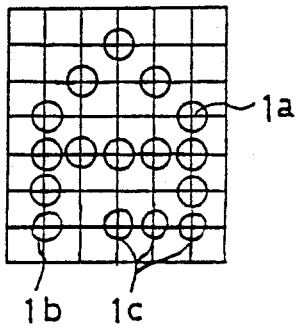

In a known display apparatus equipped with an assembly of dot matrixes to display characters and special symbols for modifying the displayed characters, such as an underline sign or a bold face discrimination sign, a desired character 1*a*, which is inputted by depressing a key, is displayed, as illustrated in FIG. 1(A) through FIG. 1(C), on a display member which is composed of a 5×7 dot matrix, having a low resolution. Then, there is displayed in FIG. 1(A), on the lowermost row of the dot matrix, a discrimination sign 1*b* denoting that the character 1*a* is a bold (i.e. thick) one; or (as shown in FIG. 1(B)) an underline sign 1*c* denoting that the character 1*a* is underlined; or (as shown in FIG. 1(C)) both a discrimination sign 1*b* and an underline sign 1*c* denoting that the character is an underlined bold character. Consequently, it has been difficult heretofore, to achieve satisfactory display of the characters 1*a* and the special symbols, such as the discrimination sign 1*b* or the underline sign 1*c*, in a clearly distinguishable state. Accordingly, such convention apparatus are deficient in accurate identification of the character and the special symbol is nearly impossible.

Although the above problem can be resolved, for example by employing a higher resolution display, such as comprised of a 5×12 dot matrix or the like, such solution leads to other problems, such as increased costs.

Figure 2:
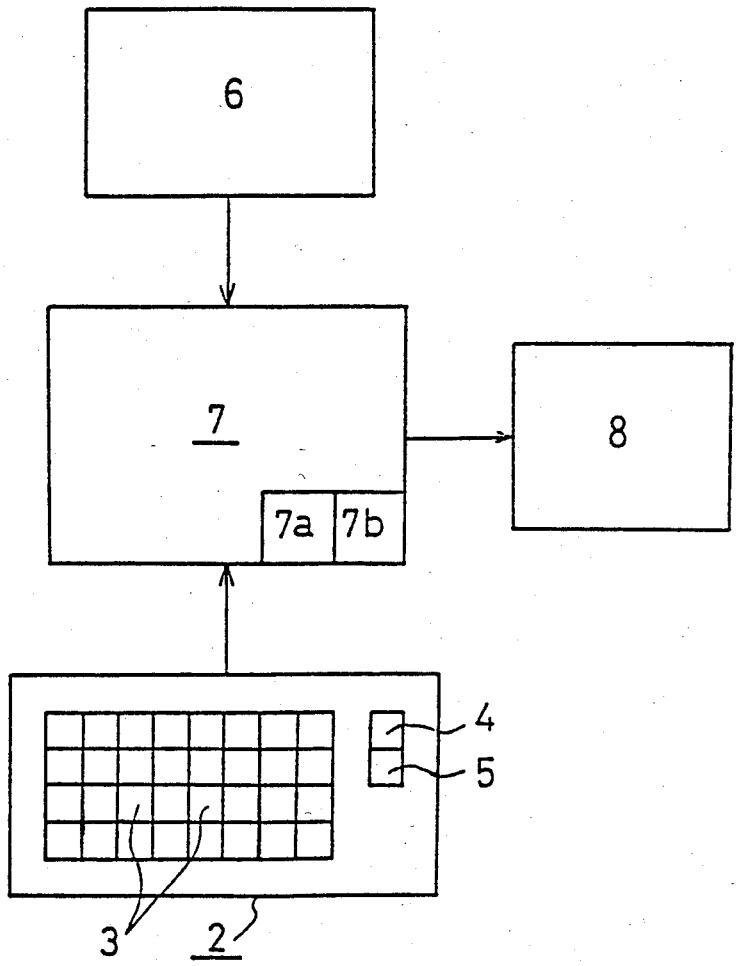
FIG. 2 is a block circuit diagram depicting a display apparatus embodying the present invention.
Figure 3:
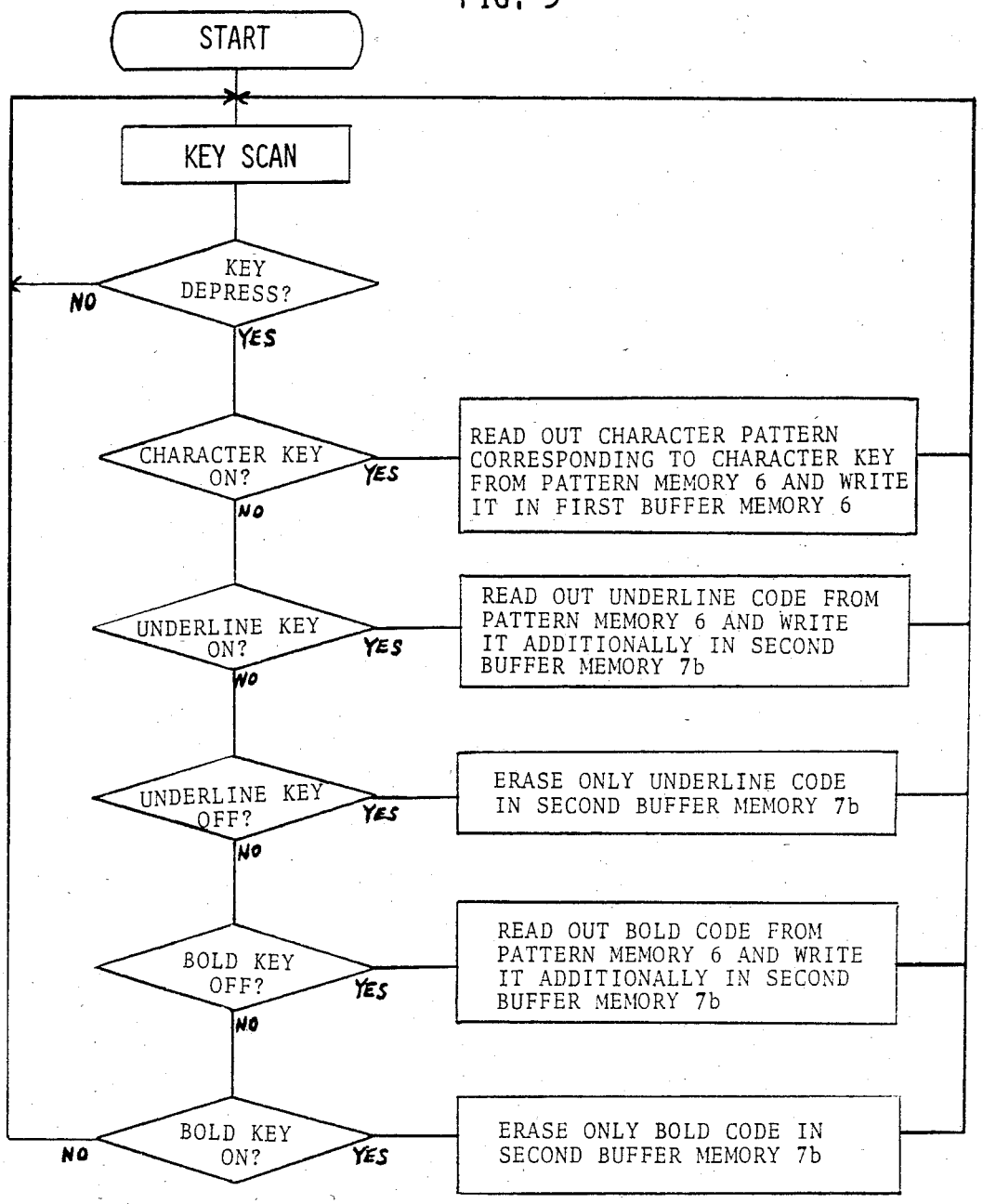
FIG. 3 is a flow chart depicting the operations performed in the apparatus of FIG. 2.
Figure 4:
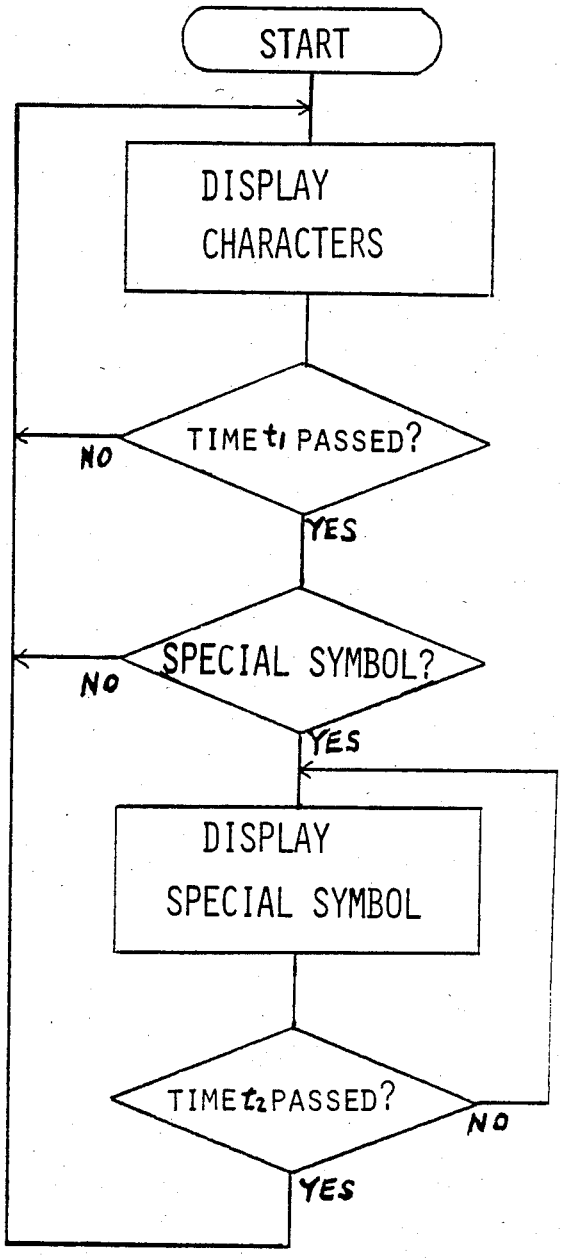
FIG. 4 is a flow chart depicting the progress of display action FIGS. 5(A), 5(B) and 5(C), each illustrates the display states of a character, and one or more special symbols, in the present invention.
Figure 5A:
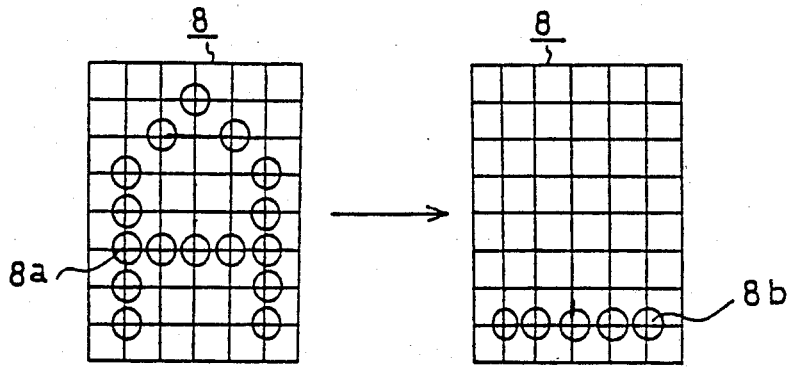
Figure 5B:
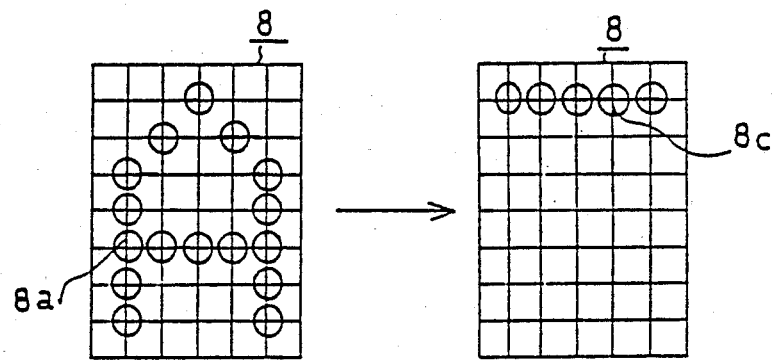
Figure 5C:
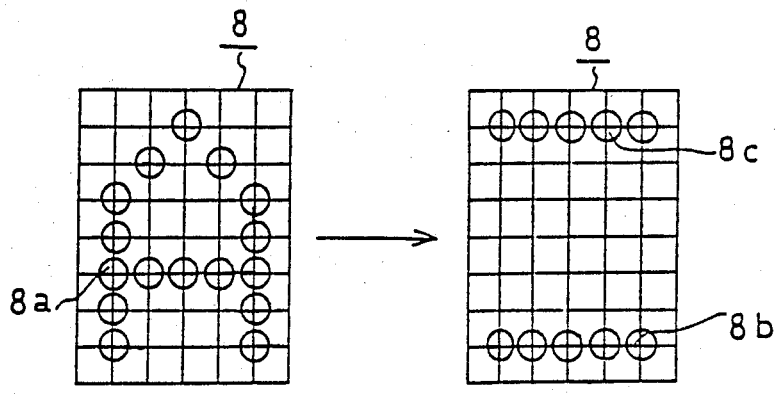

A preferred embodiment of the present invention is shown in FIGS. 2 through 4 and displayed in dot matrix depicted in FIGS. 5(A), 5(B) and 5(C). on a keyboard 2, there are arrayed a multiplicity of character keys 3, a bold set key 4 for modifying a key input character to a bold faced (i.e. thick) character, and an underline set key 5 for marking a key input character with an underline. When any of the keys 3 through 5 is depressed, a code corresponding thereto is fed to a control circuit 7. Each of the bold set key 4 and the underline set key 5, is held in its on-state once it is depressed, and is reset to be placed in its off-state when it is depressed again.

A pattern memory 6 comprises a read only memory or the like, to store therein character pattern data and special symbol pattern data (including an underline sign and a bold face discrimination sign) represented by the individual codes respectively.

In describing the operation, reference is made to the flow charts of FIGS. 3 and 4. When any of the character keys 3 is depressed, the control circuit 7 consisting of a central processing unit CPU or the like, functions in such a manner that the character pattern data accessed from the pattern memory 6 in accordance with the key input code, is written in a first buffer memory 7*a* comprising a random access memory or the like. With subsequent scanning, the buffer memory 7*a* sends the character pattern data to a display device 8, thereby displaying the key input character such as "A" by means of a 5×7 dot matrix.

When the underline set key 5 is depressed in succession to the character key 3, the control circuit 7 sets a flag in accordance with the key input code, to switch the operation to a blinking display mode and simultaneously stores the special symbol pattern data, which corresponds to the underline sign 8*b* (see FIG. 5A) and is accessed from the pattern memory 6, at a storage position in a second buffer memory 7*b* corresponding to the first buffer memory 7*a* where the character pattern data is stored.

The control circuit 7 scans the character pattern data stored in the first buffer memory 7*a*, as illustrated in FIG. 5(A) and, after displaying the key input character 8*a* for a predetermined time t1, switches the action from the first buffer memory 7*a* to the second buffer memory 7*b*. After subsequent scanning, the second buffer memory 7*b* sends the special symbol pattern data of, for example, an underline sign "_" to the display device 8, which thereby displays the underline sign 8*b* in the lowermost row of the 5×7 dot matrix (see FIG. 5A).

The control circuit 7 effects display of the under line sign 8*b* for a predetermined period of time t2 in accordance with the special symbol pattern data stored in the second buffer memory 7*b* and after switching the action from the second buffer memory 7*b* to the first buffer memory 7*a*, operates the device 8 to display the character 8*a* and the underline sign 8*b* to modify the character, alternately and repeatedly in a blinking manner, by repeating the foregoing steps.

When the bold set key 4 is depressed, as in the preceding case of the underline sign set key 5, the control circuit 7 sequentially switches the buffer memories 7*a* and 7*b*, scanned in the manner illustrated in FIG. 5(B), so that the character 8*a* and the boldface discrimination sign 8*c*, such as "-" are displayed alternately and repeatedly in a blinking manner.

In case the bold set key 4 and the underline set key 5 are depressed in succession to the character key 3, the control circuit 7 stores the special symbol pattern data, which represents the boldface discrimination sign 8*c* and the underline sign 8*b*, are accessed from the pattern memory 6, in the second buffer memory 7*b* at the storage position corresponding to the first buffer memory 7*a* where the character pattern data of the character to be modified with the special symbols, is stored. After sequentially switching the two buffer memories 7*a* and 7*b*, scanned in the same manner as in the preceding case, the control circuit 7 effects display of the character 8*a*, the underline sign 8*b* and the bold face discrimination sign 8*c* at the same position, alternately, in a blinking manner, as illustrated in FIG. 5(C).

The structure is so formed that when the bold set key 4 and the underline set key 5 are once depressed, entire characters inputted from the keyboard, after such keys are depressed, are modified with the boldface discrimination sign 8*c* and the underline sign 8*b*. Such modification is released by depressing again the bold set key 4 and the underline set key 5.

The periods of the aforementioned time t1 and t2 are so selected as to have a relationship of t1>t2, and preferably a ratio of t1:t2=5:1.

Thus, even in case the display device 8 merely has a low resolution, the embodiment described hereinabove is still capable of achieving a clearly distinguishable state in the display of each key input character 8*a* and a special symbol to modify the character, such as an underline sign 8*b* or a bold face discrimination sign 8*c*.

The foregoing description is illustrative of the principles of the invention. Numerous modifications and extensions thereof would be apparent to one skilled in the art. All such modifications and extensions are to be considered to be within the spirit and scope of this invention.

What is claimed is:

1. A keyboard type display apparatus using dot matrixes, comprising a keyboard equipped with character keys and special symbol set keys for modifying characters;

a pattern memory storing therein character pattern data and special symbol pattern data corresponding to said character keys and special symbol set keys;

a buffer memory for storing the character pattern data and the special symbol pattern data read out from said pattern memory;

a low resolution display device for displaying characters and special symbols by use of said dot matrixes in accordance with the character pattern data and the special symbol pattern data in said buffer memory;

first control means responsive to said character keys and said special symbol keys for accessing said pattern memory and for writing in said buffer memory the character pattern data and the special pattern data read out from the pattern memory; and second control means responsive to depression of said character keys and said special symbol keys for scanning the character pattern data and the special symbol pattern data written in said buffer memory and for producing repeated blinking display of the characters corresponding to the depressed character keys alternately with the special symbols corresponding to the depressed special symbol keys at the same position on said display device;

wherein said buffer memory comprises a first buffer memory for storing the character pattern data read out from said pattern memory, and a second buffer memory for storing the special symbol pattern data read out from said pattern memory;

wherein said display device displays the characters and special symbols using said dot matrixes in accordance with the character pattern data and the special symbol pattern data in said first buffer memory and in the said second buffer memory, respectively;

wherein said first control means writes in said first buffer memory the character pattern data read out from said pattern memory in accordance with the code inputted by the character key on said keyboard and further writes in said second buffer memory the special symbol pattern data read out from said pattern memory in accordance with the code inputted by said special symbol key on said keyboard;

wherein said second control means first scans the character pattern data written in said first buffer memory and displays only the corresponding character on said display device for a predetermined time period $t_1$;

wherein said second control means second after said time period $t_1$ scans the special symbol pattern data written in said second buffer memory and displays the corresponding special symbol on said display only device for a predetermined period $t_2$, wherein said period $t_1$ is greater than period $t_2$;

wherein said second control means then repeats said first scan and said second scan thereby to produce repeated blinking display of only the special signal alternately with only the character at the same position on said display device; and wherein said second control means in response to a subsequent depression of said special symbol key terminates the repeated alternate blinking display of said character and said special symbol on said display device.

* * * * *